US006560950B1

(12) United States Patent
Johansson

(10) Patent No.: US 6,560,950 B1
(45) Date of Patent: May 13, 2003

(54) OVERFOLDING DEVICE

(75) Inventor: Lennart Johansson, Uddevalla (SE)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/514,754

(22) Filed: Feb. 28, 2000

(51) Int. Cl.[7] ..... B31B 1/44
(52) U.S. Cl. ..... 53/484; 493/168
(58) Field of Search ..... 53/484, 486; 493/165, 493/168, 169, 408

(56) References Cited

U.S. PATENT DOCUMENTS 5,341,621 A * 8/1994 Martelli ..... 53/377.5
5,829,228 A * 11/1998 Mogard ..... 53/412

* cited by examiner

*Primary Examiner*—John Paradiso
(74) *Attorney, Agent, or Firm*—Welsh & Katz, LTD.

(57) ABSTRACT

An overfolding device for overfolding the top panels of a formed, filled and sealed gable top carton is disclosed herein. The overfolding of the top panels eliminates the convexing of the top panels due to a springback effect inherent in the packaging material of the carton, and thus provides a flat top panel for placement of a fitment thereon by a post processing fitment applicator. The overfolding device may be positioned directly subsequent to a top sealing station of a form, fill and seal packaging machine such as a TETRA REX® packaging machine. The overfolding device includes an attachment means, a movement means and a folding mechanism. The folding mechanism may include a plurality of projection members, a plurality of engagement members and a frame.

20 Claims, 6 Drawing Sheets

OVERFOLDING DEVICE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an overfolder for a gable top carton. More specifically, the present invention relates to an arrangement on a form, fill and seal packaging machine for overfolding the top panel of a gable top carton to create a flatter top panel for placement of a fitment thereon.

2. Description of the Related Art

Gable top cartons have long been the preferred package for milk and milk related products. Recently, gable top cartons have assumed a new role as the preferred package for juices, particularly orange juice. The consumers preference for gable top cartons is at least partially generated by the perception of freshness associated with the gable top carton. The opposing top panels meeting to form the gable top with a top fin creates an image of a fresh, healthy product contained within the carton. The only detraction from this image was the lack of a tight reseal of the carton after the initial opening of the carton by a consumer. The integrated closure formed from the side of the top of the carton allowed for good pourability, however, the resealing was adequate at best.

This minor detraction was alleviated with the introduction of plastic fitments applied to the gable top cartons. The fitments, which generally include a spout with a flange and a cap, allowed for a tight reseal of the carton after the initial opening. The use of fitments on cartons further enhanced the consumer's perception that gable top cartons contained fresh and healthy products.

In the rush to meet the consumer's demand, the packaging industry developed new packaging/filling machines that applied a fitment to cartons prior to sterilization or filling. The demand to have packaging machines with the smallest "footprint" (the area of the machine) in a dairy meant that most older machines did not have sufficient space within the machine to incorporate a fitment applicator. This rendered older machines without the ability to provide a carton with a fitment thereby reducing their value to the dairy or like facility. Thus a need to apply a fitment on a formed, filled and sealed carton grew throughout the packaging industry.

Another problem necessitating the need to apply a fitment on a formed, filled and sealed carton pertains to maintaining a sterile environment within a form, fill and seal packaging machine to produce an extended shelf life ("ESL") product, a high acid ambient distribution ("HAAD") product, or an aseptic product. The ESL product allows for a product to have double or triple the refrigerated shelf life of a non-ESL product. The HAAD product allows for a high acid (pH<4.5) product such as orange juice to be stored unrefrigerated for an extended time period. The aseptic product allows for any product to be stored unrefrigerated for an extended time period. All of these products need to be produced in a sterile, contaminant-free environment which would tend away from in-line fitment applicators and toward the use of post processing fitment applicators.

In order to have good adhesion between the back of the fitment and a top panel of a gable top carton, the top panel should be as flat as possible. However, gable top cartons are fabricated from flattened carton blanks which create a tendency in the packaging material to springback when folded and sealed into the finished carton. This springback effect causes the top panel to convex thereby creating a poor substrate for attachment of a fitment thereto. The packaging industry has yet to provide a solution to this problem.

BRIEF SUMMARY OF THE INVENTION

It is a primary object of the present invention to provide an arrangement on a packaging machine for overfolding a top panel of a form, filled and sealed gable top carton to create a flatter top panel for placement of a fitment thereon.

It is an additional object of the present invention to an arrangement that overfolds a top panel of a gable top carton subsequent to top sealing of the carton on a form, fill and seal packaging machine.

It is an additional object of the present invention to provide an arrangement capable of flattening a convex top panel of a formed, filled and sealed gable top carton.

One aspect of the present invention is an apparatus for overfolding a top panel of a formed, filled and sealed gable top carton. The apparatus includes a bracket, a folding mechanism and a moving means. The folding mechanism is attached to the bracket and is disposed above a carton pathway for contact with the formed, filled and sealed carton to overfold a top panel of the formed, filled and sealed carton. The moving means moves the folding mechanism from a stationary position to an engagement position.

The folding mechanism may include a plurality of projection members extending from a frame toward the formed, filled and sealed carton, and a plurality of engagement members. Each of the plurality of engagement members are connected to a corresponding projection member at an end of the projection member opposite the connection of the projection member to the frame. Each of the engagement members may be rounded for non-damaging pressing against the carton. The moving means may be a pneumatic cylinder, a servomotor, a cam/gear arrangement, or the like. The projection member and the engagement member may provide a predetermined length to avoid contact between the frame and a top fin of the formed, filled and sealed carton during the overfolding operation.

Another aspect of the present invention is an arrangement for over-folding a top panel of a formed, filled and sealed gable top carton on a packaging machine for forming, filling and sealing a series of cartons being conveyed along a pathway. The arrangement includes a bracket, a folding mechanism and a moving means. The bracket is connected on one end to the packaging machine subsequent to a top sealing station of the packaging machine. The folding mechanism is attached to the bracket and is disposed above the carton pathway for contact with the formed, filled and sealed carton to overfold a top panel of the formed, filled and sealed carton. The moving means moves the folding mechanism from a stationary position to an engagement position.

The folding mechanism of the arrangement may include a plurality of projection members extending from a frame toward the formed, filled and sealed carton, and a plurality of engagement members. Each of the plurality of engagement members are connected to a corresponding projection member at an end of the projection member opposite the connection of the projection member to the frame. Each of the engagement members of the arrangement may be rounded for non-damaging pressing against the carton. The moving means of the arrangement may be a pneumatic cylinder, a servomotor, a cam/gear arrangement or the like. The projection member and the engagement member of the arrangement may provide a predetermined length to avoid contact between the frame and a top fin of the formed, filled and sealed carton during the overfolding operation. The arrangement may be positioned directly subsequent to a top sealing station of the packaging machine.

Another aspect of the present invention is a method for overfolding a top panel of a formed, filled and sealed carton. The first step of the method is conveying a formed, filled and sealed carton to a overfolding station. The next step is moving a folding mechanism of the overfolding station toward a top panel of the formed, filled and sealed carton. The next step is pressing the folding mechanism against the top panel of the formed, filled and sealed carton. The next step is moving the folding mechanism away from the top panel of the formed, filled and sealed carton.

The method may also include top sealing the carton prior to conveying the carton to the overfolding station. The method may also include synchronizing the movement of the folding mechanism with the movement of each of the cartons.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

There is illustrated in FIG. 1 a schematic view of a packaging machine with the overfolding device of the present invention integrated therein.

There is illustrated in FIG. 2 a top perspective view of a carton prior to undergoing overfolding by the overfolding device of the present invention.

Figure 2:
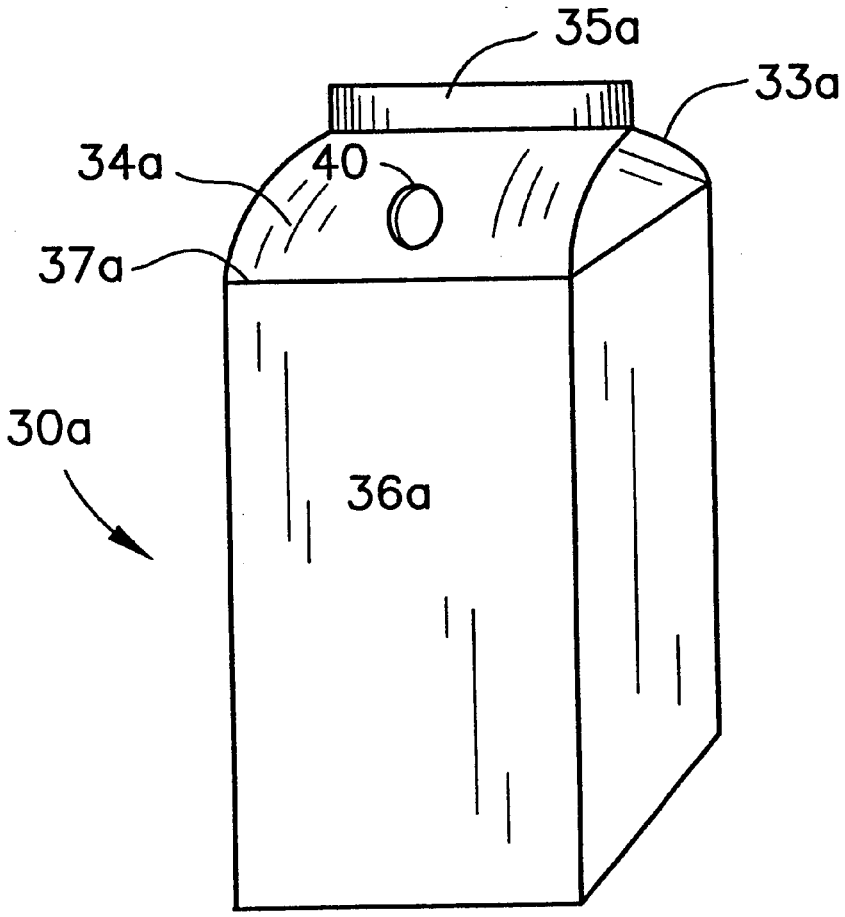
Figure 2A:
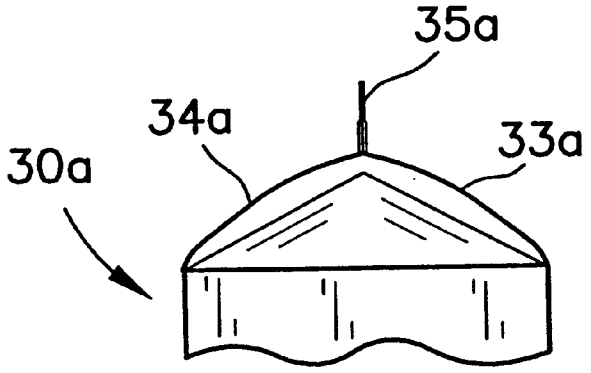

There is illustrated in FIG. 2A a side view of the top of the carton of FIG. 2.

Figure 3:
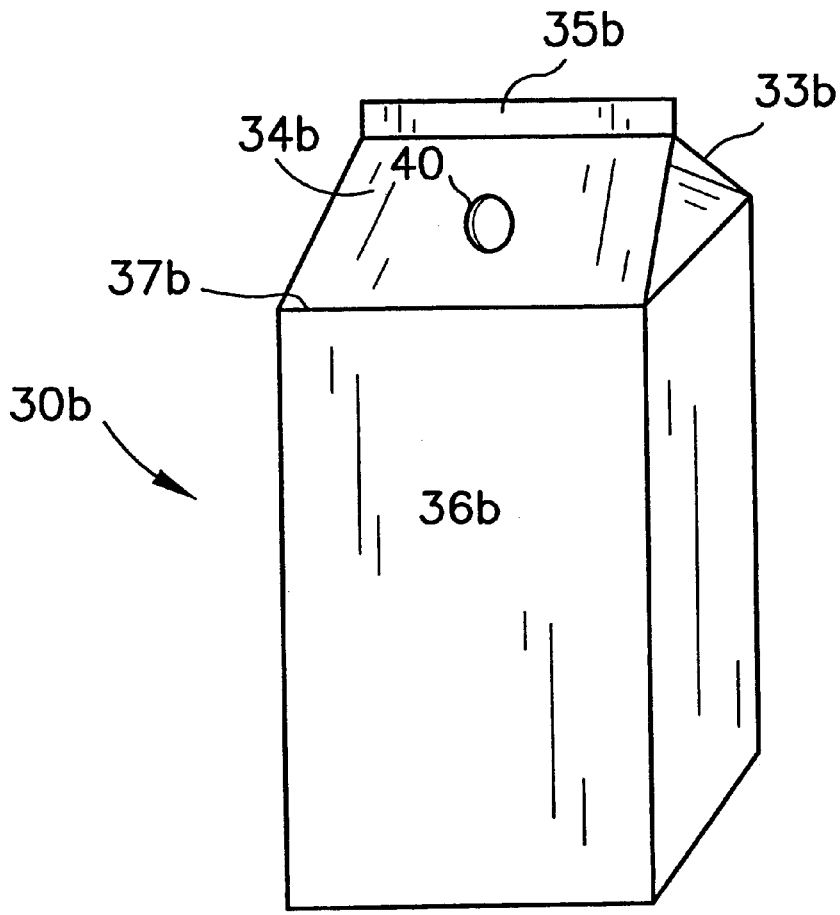

There is illustrated in FIG. 3 a top perspective view of a carton subsequent to undergoing overfolding by the overfolding device of the present invention.

Figure 3A:
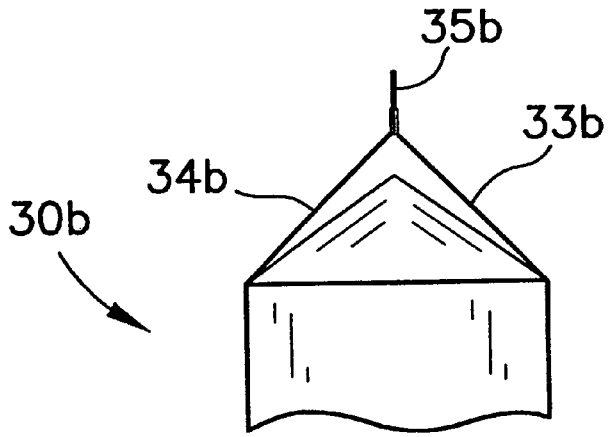

There is illustrated in FIG. 3A a side view of the top of the carton of FIG. 3.

Figure 4:
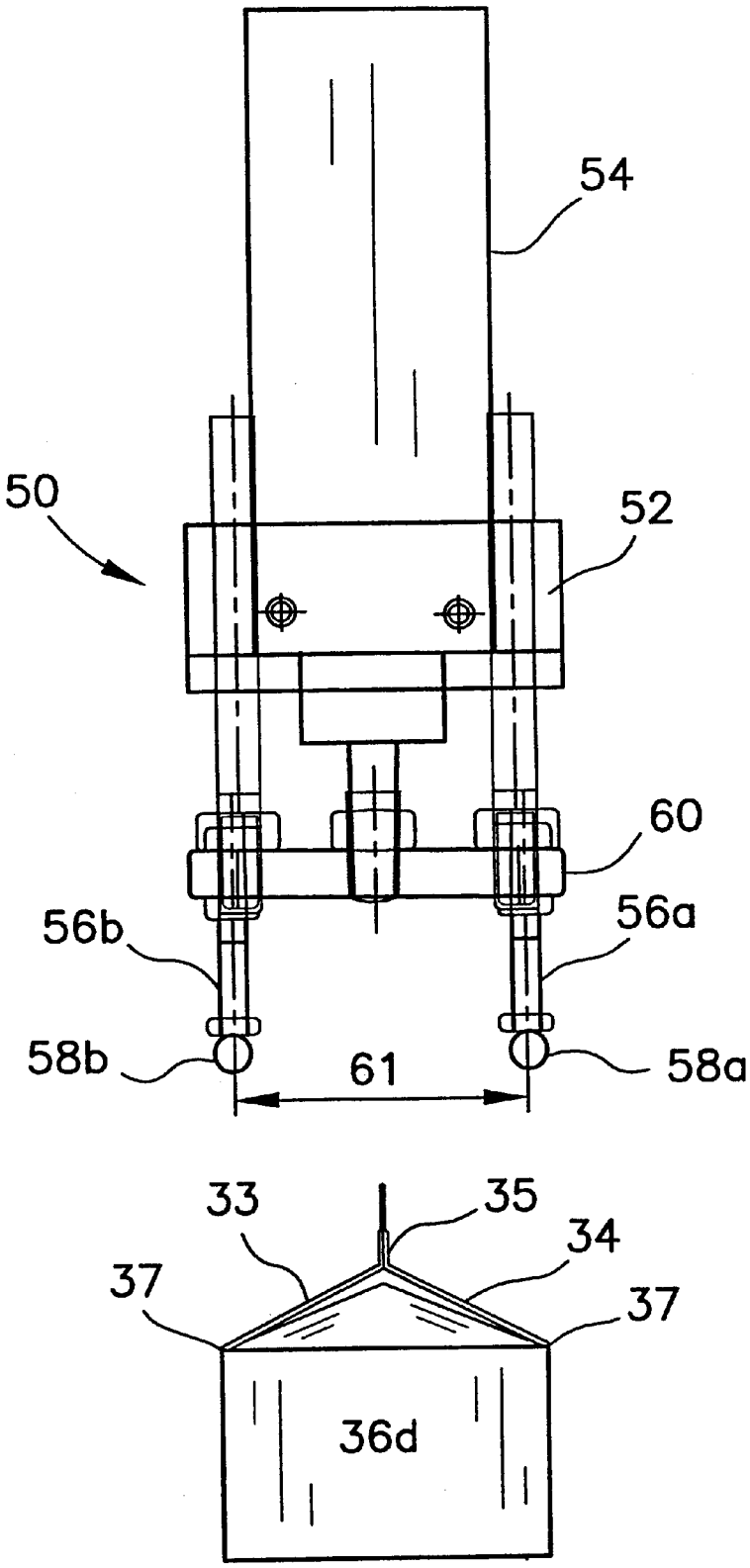

There is illustrated in FIG. 4 an isolated side view of the overfolding device of the present invention.

Figure 5:
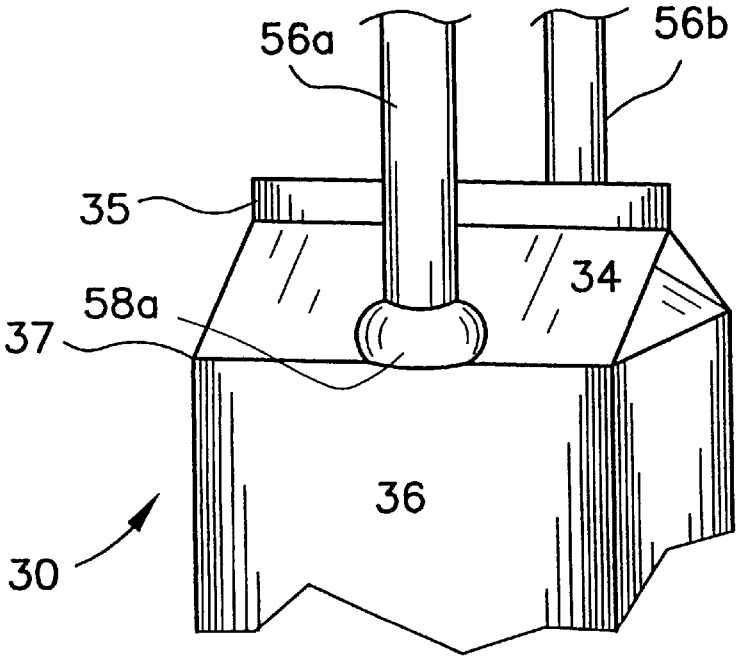

There is illustrated in FIG. 5 an isolated front view of the overfolding device of the present invention engaging the top panel of a carton.

Figure 6:
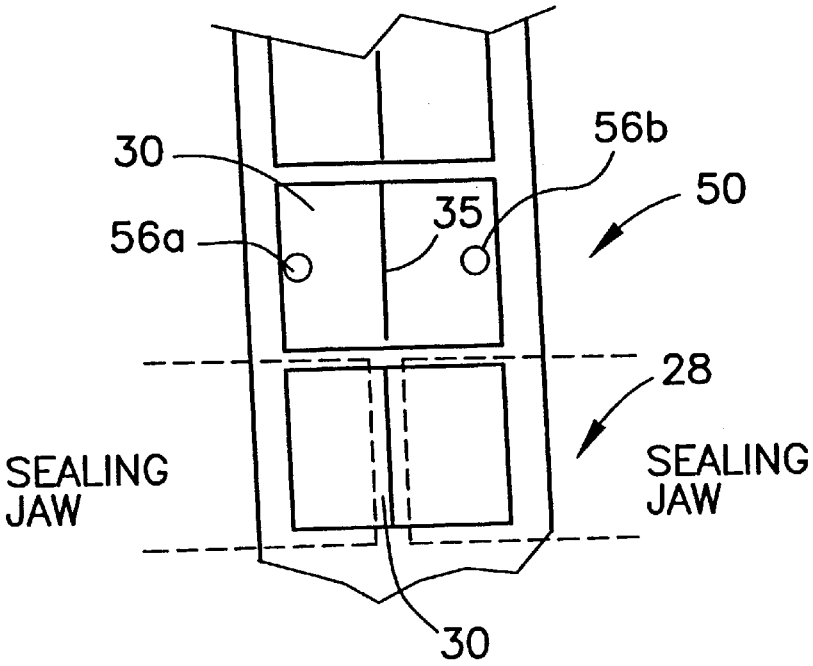

There is illustrated in FIG. 6 a top plan view of the overfolding device of the present invention engaging a carton being conveyed along a carton pathway.

Figure 7:
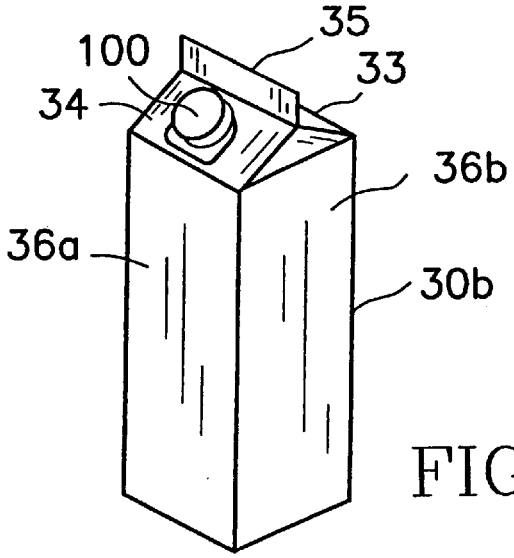

There is illustrated in FIG. 7 a top perspective view a carton with a fitment attached thereon subsequent to undergoing overfolding by the overfolding device of the present invention.

Figure 7A:
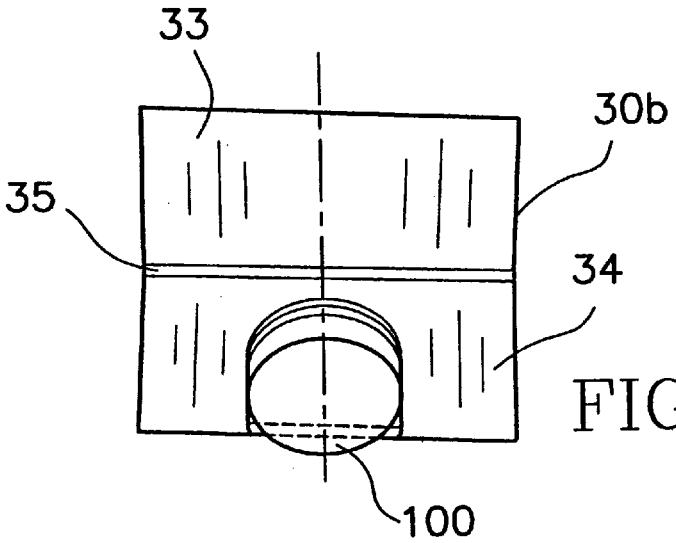

There is illustrated in FIG. 7A a top plan view of FIG. 7.

Figure 7B:
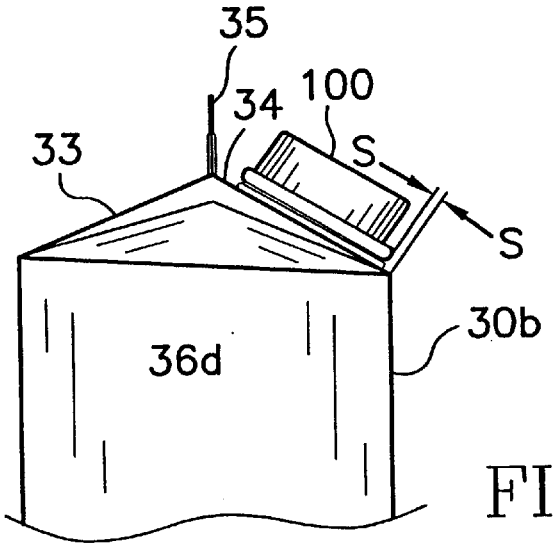

There is illustrated in FIG. 7B a side plan view of FIG. 7.

DETAILED DESCRIPTION OF THE INVENTION

Figure 1:
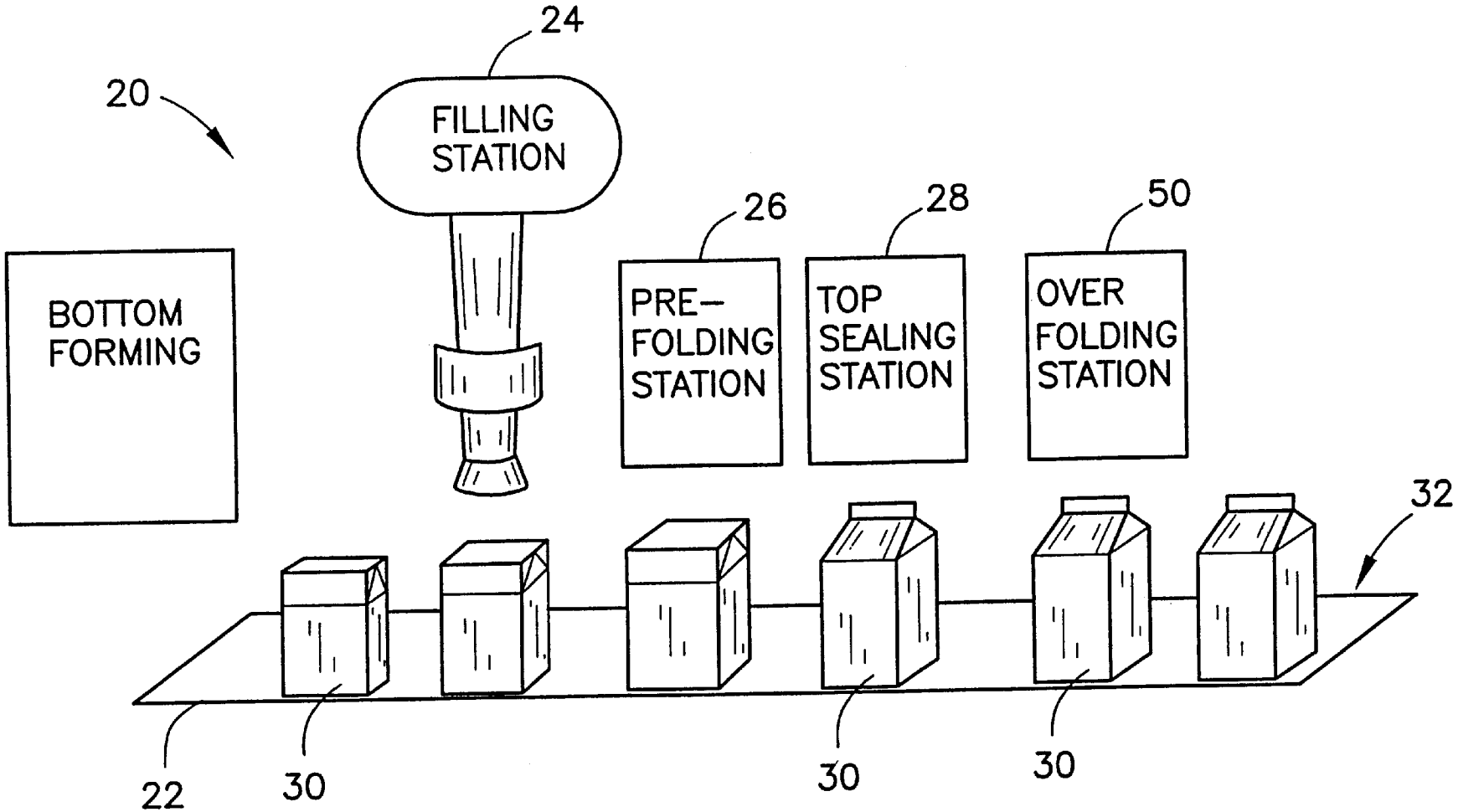

As shown in FIG. 1, a packaging machine 20 generally includes a conveyor system 22, a filling station 24, a pre-folding station 26, a top sealing station 28 and an outlet 32. A series of cartons are conveyed along the conveyor system 22 through the stations and to the outlet 32. An example of such a packaging machine for forming, filling and sealing gable top cartons from a blank is a TETRA REX® packaging machine available from Tetra Pak, Incorporated of Chicago, Ill. In order to create a flatter top panel for each of the cartons 30 for attachment of a fitment thereto, an overfolding station/apparatus 50 of the present invention may be located subsequent to the top sealing station 28.

A flatter top panel allows for better attachment of a fitment to the formed, filled and sealed carton by a post processing fitment applicator such as disclosed in co-pending U.S. patent application Ser. No. 09/238768 U.S. Pat. No. 6,205,746 (Corporate Docket Number TRX-0613), entitled Post Processing Fitment Applicator, filed on even date herewith, and hereby incorporated by reference in its entirety.

In operation, a series of cartons 30 is conveyed along the pathway defined by the conveyor system 22 in a predetermined indexed motion, usually corresponding to the time period needed to effect a top seal on a carton 30 at the top sealing station 28. The cartons 30 are fed into the packaging machine 20 as flattened blanks from a magazine, not shown. The flattened blanks are erected and placed on a mandrel, not shown, for bottom forming. Once the bottom is formed, the partially-formed carton 30 is discharged to the conveyor system 22 and conveyed to the filling station 24. Optionally, the carton 30 may be sterilized at a sterilization station, not shown, prior to filling at the filling station 24. After the carton 30 is filled with a desired product at the filling station 24, the top panels of the carton 30 are pre-folded at the pre-folding station 26. The top panels are pre-folded to initially break the score lines that partition the top panels from the side panels of the carton 30. The diagonal score lines that allow for the formation of the gable top are also initially broken at the pre-folding station 26.

The carton 30 is then conveyed to the top sealing station 28 where the top fin panels of the carton 30 are sealed together, usually by ultrasonic sealing, to complete the formed, filled and sealed carton 30. However, due to its origins as a flattened blank, the carton 30a, as shown in FIGS. 2 and 2A, has top panels 33*a* and 34*a* that have a tendency to convex in shape due to a springback effect in the packaging material which is usually a paperboard substrate coated with polyethylene. As shown in FIGS. 2 and 2A, the top panel 34*a* begins to convex at a score line 37 that partitions the side panel 36*a* from the top panel 34*a* The convexing of the top panels 33*a* and 34*a* creates a difficult substrate for attachment of a fitment thereto since the fitment usually has a flat back or flange area. Thus, the flatter the surface of the top panel 33 and 34, the greater the surface area for adhesion of the fitment thereto. A partially-incised area 40 designates the attachment area for the fitment. The area 40 may also be an aperture with a membrane thereon.

FIGS. 3 and 3A illustrate the carton 30*b* subsequent to undergoing overfolding by the overfolding apparatus 50. The top panels 33*b* and 34*b* are essentially flat, providing a relatively, smooth and straight surface for attachment of a fitment thereto.

FIGS. 4–6 illustrate the operation of the overfolding apparatus 50. The overfolding apparatus 50 generally includes a bracket 52 or other means for mounting the apparatus 50 to the packaging machine 20, a pneumatic cylinder 54 connected to the bracket 52, and a folding mechanism 55. The folding mechanism 55 is driven by the-pneumatic cylinder 54 toward and away from the top panels 33 and 34 of the carton 30 conveyed below on the conveyor system 22. The folding mechanism 55 may alternatively be moved or actuated by a servomotor, a cam/gear arrangement, or like actuation means.

The folding mechanism 55 includes a frame 60, a plurality of projection members 56*a–b* and a plurality of engagement members 58*a–b*. The engagements members 58*a–b* are connected to corresponding projection members 56*a–b*. The projection members 56*a–b* are spaced apart from each other a predetermined distance corresponding to the width of the carton 30 from side to side. For example, a carton having a cross-section of ninety-five millimeters by ninety-five millimeters will necessitate the projection members 56*a–b* being approximately ninety-five millimeters apart, with an error toward less than ninety-five millimeters. For a carton with a cross-section of seventy millimeters by seventy millimeters, the projection members 56*a–b* will be approximately seventy millimeters apart, with an error toward less than seventy millimeters. Further, the frame 60 that the projection members 56*a–b* are connected to, must not contact the top fin 35 of the carton 30. Thus, the projection members 56*a–b* along with the engagement members 58*a–b*, must have a length that allows for the frame 60 to avoid contact with the top fin 35 when the folding mechanism is in operation and pressing against the top panels 33 and 34. Further, the engagement members 58*a–b* should have a smooth, preferably rounded surface to avoid puncturing or otherwise damaging the top panels 33 and 34, or any other part of the carton 30. Further, the downward movement must be precise to allow for the proper amount of pressing of the top panels 33 and 34, or score line 37, without permanently depressing the carton 30. The folding mechanism 55 is positioned above the conveyor system 22 to contact the top panels 33 and 34 at about the center of the score line 37 in order to press the score lines 37 to essentially bend the fibers in the packaging material to render the top panels 33 and 34 flat for attachment of a fitment thereto.

As shown in FIG. 6, the overfolding apparatus/station 50 is positioned directly after the top sealing station 28. Alternatively, the overfolding apparatus 50 may be positioned further downline from the top sealing station 28, or it is conceivable that the overfolding apparatus 50 may be placed on the post processing fitment applicator machine.

Still referring to FIG. 6, the engagement members 58 are shown contacting the score line 37 of the top panels 33 and 34. The entire overfolding operation should be completed within the single indexed movement of the carton 30. Thus, the folding mechanism 55 is moved toward the carton 30, engages the top panels 33 and 34, and then returns to a non-operative state all within the predetermined indexed movement time period. The movement of the cylinder 54, or any other actuation means for the folding mechanism 55, may be connected to the movement of the conveyor system 22 to synchronize its motion.

The overfolded carton 30*b* as shown in FIGS. 3 and 3A, is transferred from the packaging machine 20 to a post processing fitment applicator As shown in FIGS. 7, 7A and 7B, a fitment 100 is attached to the carton 30 over the access area 40 to provide access to the product contained within the carton 30. The fitment 100 provides a means for a consumer to puncture the access area 40 during the initial opening of the carton 30. Without the flattened top panels 33 and 34, the fitment 100 may not properly adhere to the carton 30 rendering the carton 30 defective.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. An apparatus for overfolding a top panel of a formed, filled and sealed gable top carton being transported along a carton pathway, the apparatus comprising:

a bracket;

an overfolding mechanism attached to the bracket, the overfolding mechanism disposed above the carton pathway for contact with the formed, filled and sealed carton to overfold a top panel of the formed, filled and sealed carton; and means for moving the overfolding mechanism from a stationary position to an engagement position.

2. The apparatus according to claim 1 wherein the overfolding mechanism comprises a plurality of projection members extending from a frame toward the formed, filled and sealed carton, and a plurality of engagement members, each of the plurality of engagement members connected to a corresponding projection member at an end of the projection member opposite the connection of the projection member to the frame.

3. The apparatus according to claim 2 wherein each of the engagement members are rounded for non-damaging pressing against the carton.

4. The apparatus according to claim 2 wherein the projection member and the engagement member provide a predetermined length to avoid contact between the frame and a top fin of the formed, filled and sealed carton.

5. The apparatus according to claim 1 wherein the moving means is a pneumatic cylinder.

6. The apparatus according to claim 1 wherein the moving means is a servomotor.

7. An arrangement for overfolding a top panel of a formed, filled and sealed gable top carton on a packaging machine for forming, filling and sealing a series of cartons being conveyed along a pathway, the arrangement comprising:

a bracket connect on one end to the packaging machine subsequent to a top sealing station of the packaging machine;

an overfolding mechanism attached to the bracket, the overfolding mechanism disposed above the carton pathway for contact with the formed, filled and sealed carton to overfold a top panel of the formed, filled and sealed carton; and means for moving the overfolding mechanism from a stationary position to an engagement position.

8. The arrangement according to claim 7 wherein the overfolding mechanism comprises a plurality of projection members extending from a frame toward the formed, filled and sealed carton, and a plurality of engagement members, each of the plurality of engagement members connected to a corresponding projection member at an end of the projection member opposite the connection of the projection member to the frame.

9. The arrangement according to claim 8 wherein each of the engagement members are rounded for non-damaging pressing against the carton.

10. The arrangement according to claim 8 wherein the projection member and the engagement member provide a predetermined length to avoid contact between the frame and a top fin of the formed, filled and sealed carton.

11. The arrangement according to claim 7 wherein the moving means is a pneumatic cylinder.

12. The arrangement according to claim 7 wherein the moving means is a servomotor.

13. The arrangement according to claim 7 wherein the overfolding arrangement is positioned directly subsequent to a top sealing station of the packaging machine.

14. A method for overfolding a top panel of a formed, filled and sealed carton, the method comprising:

conveying a formed, filled and sealed carton to a overfolding station;

moving an overfolding mechanism of the overfolding station toward a top panel of the formed, filled and sealed carton;

pressing the overfolding mechanism against the top panel of the formed, filled and sealed carton; and moving the overfolding mechanism away from the top panel of the formed, filled and sealed carton.

15. The method according to claim 14 further comprising top sealing the carton prior to conveying the carton to the overfolding station.

16. The method according to claim 14 wherein the overfolding mechanism comprises a plurality of projection members extending from a frame toward the formed, filled and sealed carton, and a plurality of engagement members, each of the plurality of engagement members connected to a corresponding projection member at an end of the projection member opposite the connection of the projection member to the frame.

17. The method according to claim 16 wherein each of the engagement members are rounded for non-damaging pressing against the carton.

18. The method according to claim 14 wherein the moving of the overfolding mechanism is provided by a pneumatic cylinder.

19. The method according to claim 16 wherein the projection member and the engagement member provide a predetermined length to avoid contact between the frame and a top fin of the formed, filled and sealed carton.

20. The method according to claim 14 wherein the movement of the overfolding mechanism is synchronized with the movement of each of the cartons.

* * * * *